United States Patent [19]

Mandel et al.

[11] Patent Number: 4,646,058

[45] Date of Patent: Feb. 24, 1987

[54] ELEVATOR SYSTEM WITH LAMP FAILURE MONITORING

[75] Inventors: Alan F. Mandel, Mt. Lebanon; Kenneth M. Eichler, North Versailles, both of Pa.; William H. Moore, Bridgewater, N.J.

[73] Assignee: Westinghouse Electric Corp., Pittsburgh, Pa.

[21] Appl. No.: 741,420

[22] Filed: Jun. 5, 1985

[51] Int. Cl.[4] ..... B66B 3/00

[52] U.S. Cl. ..... 187/100

[58] Field of Search ..... 187/29 R; 340/19 R, 340/642, 641, 21

[56] References Cited

U.S. PATENT DOCUMENTS 3,706,972 12/1972 Okuhara .
3,706,983 12/1972 Olson et al. .
4,173,750 11/1979 Riba .
4,217,576 8/1980 Wreford-Howard ..... 340/642
4,234,878 11/1980 Stark .
4,295,079 10/1981 Otsuka et al. .
4,307,392 12/1981 Loshbough et al. .
4,323,841 4/1982 Jacobsen .
4,354,181 10/1982 Spletzer .
4,555,689 11/1985 Brick et al. ..... 340/19 R

*Primary Examiner*—James L. Rowland
*Assistant Examiner*—Brian R. Tumm
*Attorney, Agent, or Firm*—D. R. Lackey

[57] ABSTRACT

An elevator system which includes a plurality of lamps, each associated with a different floor number of an associated building. Lamp burn-out is detected via a single current sensor disposed in the common return of the lamps, along with logic which indicates when a test should be made, and which lamp is being tested. Detection of a burned-out lamp is stored for maintenance purposes.

6 Claims, 8 Drawing Figures

ELEVATOR SYSTEM WITH LAMP FAILURE MONITORING

BACKGROUND OF THE INVENTION

1. Field of the Invention:

The invention relates in general to elevator systems, and more specifically to the detection of burnedout lamps in an elevator system.

2. Description of the Prior Art:

One of the most troublesome problems in the maintenance and servicing of an elevator system, is the detection of burned-out lamps, or other similar indicators. The detection of such failures is labor intensive, requiring service personnel to ride each elevator car and check the associated up and down hall lanterns at each floor, as well as the up and down hall call registered lamps associated with the up and down hall call pushbuttons at each floor. The car position indicator in the elevator car must be observed as the car travels between terminal floors, and car calls must be entered for all floors in order to observe the car call registered indicator lamps. Thus, it would be desirable to reduce the labor required to detect such lamp failures, while at the same time improving the operation of the elevator system by early detection of such failures.

SUMMARY OF THE INVENTION

Briefly, the present invention relates to an elevator system having a plurality of lamps which are automatically and continuously tested for operability as each elevator car of the elevator system goes about its normal everyday activities. Detection of a lamp failure, as well as an indication of the specific lamp involved, is automatically stored in a memory. The contents of the memory may be periodically transferred to a remote maintenance office, or it may be periodically read by on-site maintenance personnel, as desired.

The lamps of a predetermined elevator function are tested by a single current sensor disposed to detect the magnitude of the current flow in the common power supply return, to which all of the lamps of the function are connected. Logic associated with the predetermined elevator function determines when each test should be made. When only one lamp will be energized at a time, such as sequentially in a car position indicator, or randomly, such as a hall lantern, the logic indicates each time a different lamp should be energized, so a current level check may be made. Current flow below a predetermined magnitude results in storing an indication of a burned-out lamp, with the stored information including the floor number associated with the lamp. When any number of lamps may be energized at one time, such as hall call registered lamps, or car call registered lamps, the logic determines when only a single hall call is registered or when only a single car call is registered, and a test is made at that time. If current flow in the common power supply return is below a predetermined value, an indication of a burned-out lamp is stored in memory, along with the floor number associated with the lamp being tested.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
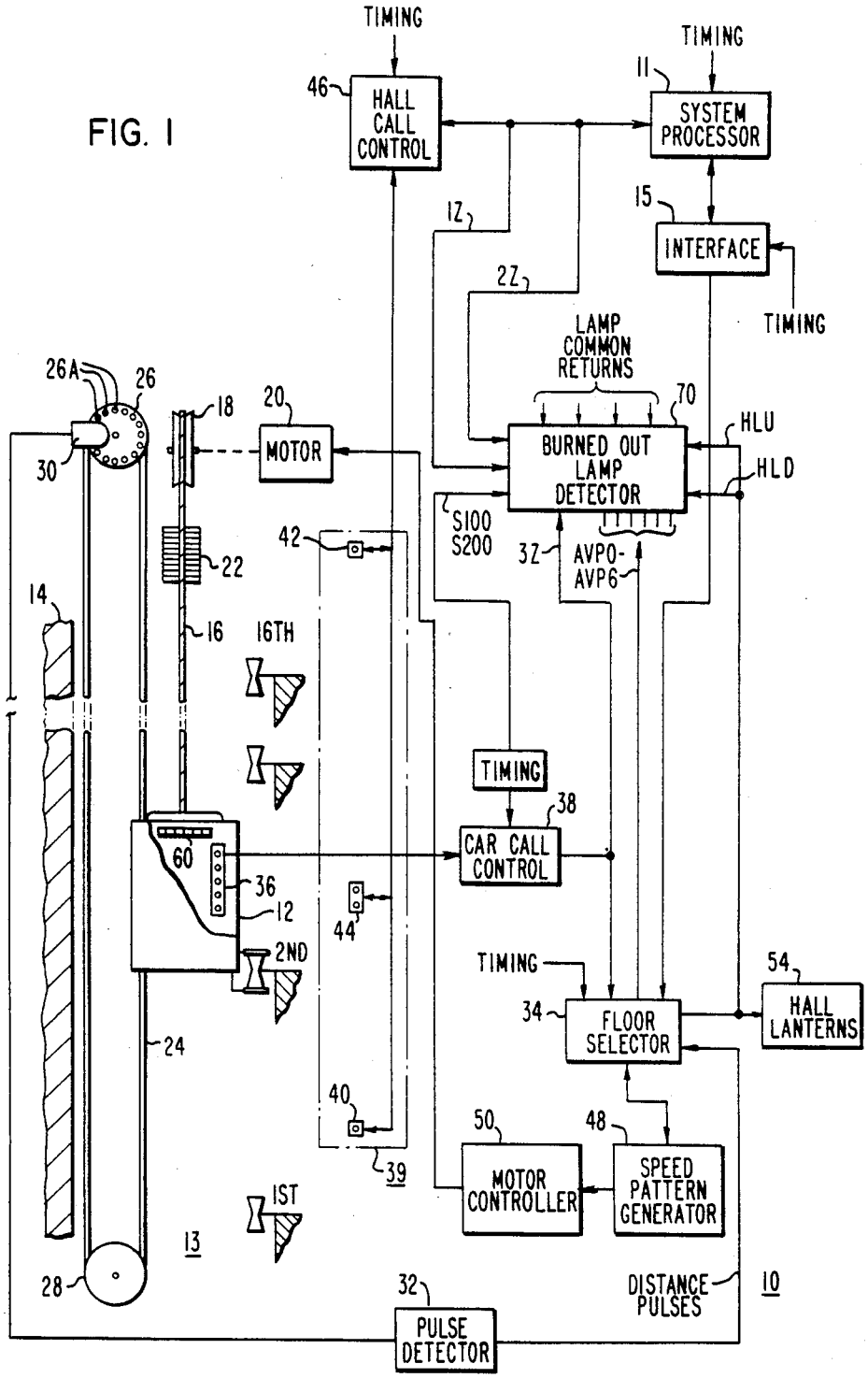
FIG. 1 is a schematic diagram of an elevator system having burned-out lamp detector means which may be constructed according to the teachings of the invention.

Referring now to the drawings, and to FIG. 1 in particular, there is shown an elevator system 10 which may utilize the teachings of the invention. FIG. 1 is similar to FIG. 1 of U.S. Pats. Nos. 3,804,209 and 3,750,850, which patents are hereby incorporated into the present application by reference. Only that part of elevator system 10 which is necessary in order to understand the present invention will be described in detail. Elevator system 10 includes one or more elevator cars, such as car 12. When a plurality of cars are in system 10, they may be controlled by a system processor 11 which includes group supervisory control. Since each of the cars of a bank of cars, and the controls therefor, would be similar in construction and operation, only the controls for car 12 will be described in detail.

More specifically, elevator car 12 is mounted in a hatchway 13 for movement relative to a structure 14 having a plurality of landings, such as sixteen landings, with only the first, second and sixteenth landings being shown in order to simplify the drawing. Elevator car 12 is supported by a plurality of wire ropes 16, which are reeved over a traction sheave 18 mounted on the shaft of an AC or a DC drive motor 20. A counterweight 22 is connected to the other end of ropes 16. A governor rope 24 which is connected to the top and bottom of the elevator car is reeved about a governor sheave 26 and a pulley 28. A pick-up 30 detects movement of the car 12 through the effect of circumferentially spaced openings 26a in a pulse wheel driven with the governor sheave 26. The openings in the pulse wheel are spaced to provide a pulse for each standard increment of travel of car 12, such as a pulse for each 0.25 inch of car travel. Pick-up 30 provides pulses for a pulse detector 32 which in turn provides distance pulses for a floor selector 34.

Car calls, as registered by pushbutton array 36 mounted in the car 12, are recorded and serialized in car call control 38, and the resulting serialized car call information 3Z is directed to the floor selector 34.

Hall calls, as registered by pushbuttons mounted in the hallways, shown generally at 39, such as the up pushbutton 40 located at the first landing, the down pushbutton 42 located at the sixteenth landing, and the up and down pushbuttons 44 located at the second and other intermediate landings, are recorded and serialized in hall call control 46. The resulting serialized up and down hall call information 1Z and 2Z, respectively, is directed to the system processor 11. The system processor 11 directs the hall calls to the cars through an interface circuit, shown generally at 15, to effect efficient service for the various floors of the building and effective use of the elevator cars.

The floor selector 34 processes the distance pulses from pulse detector 32 in counters. The counters develop information concerning the exact position of the elevator car 12 in the hoistway, in terms of the standard increment, measured from the lowest floor. The advanced car position AVP, provided by binary signal AVPO-AVP6 in terms of the floor number, is also developed. The advanced car position is the floor number, in binary, where the elevator car is located, when it is standing, and the number of the closest floor in the travel direction of the elevator car where it can make a normal stop, when it is moving. A car position indicator 60 in the elevator car 12 indicates the floor of the advanced car position. The floor selector 34 also directs these processed distance pulses to a speed pattern generator 48, which generates a speed reference signal for a motor controller 50, which in turn provides the drive voltage for motor 20. The floor selector 34 keeps track of the car 12, the calls for service for the car, and it provides the request-to-accelerate signal to the speed pattern generator 48. The floor selector also provides the deceleration signal for the speed pattern generator 48 at the precise time required for the car to decelerate according to a predetermined deceleration speed pattern and stop at a target floor for which a call for service has been registered. The floor selector 34 also provides signals HLU and HLD for controlling the up and down hall lanterns 54, respectively, and it controls the resetting of the car call and hall call controls when a car or hall call has been serviced.

Figure 2A:
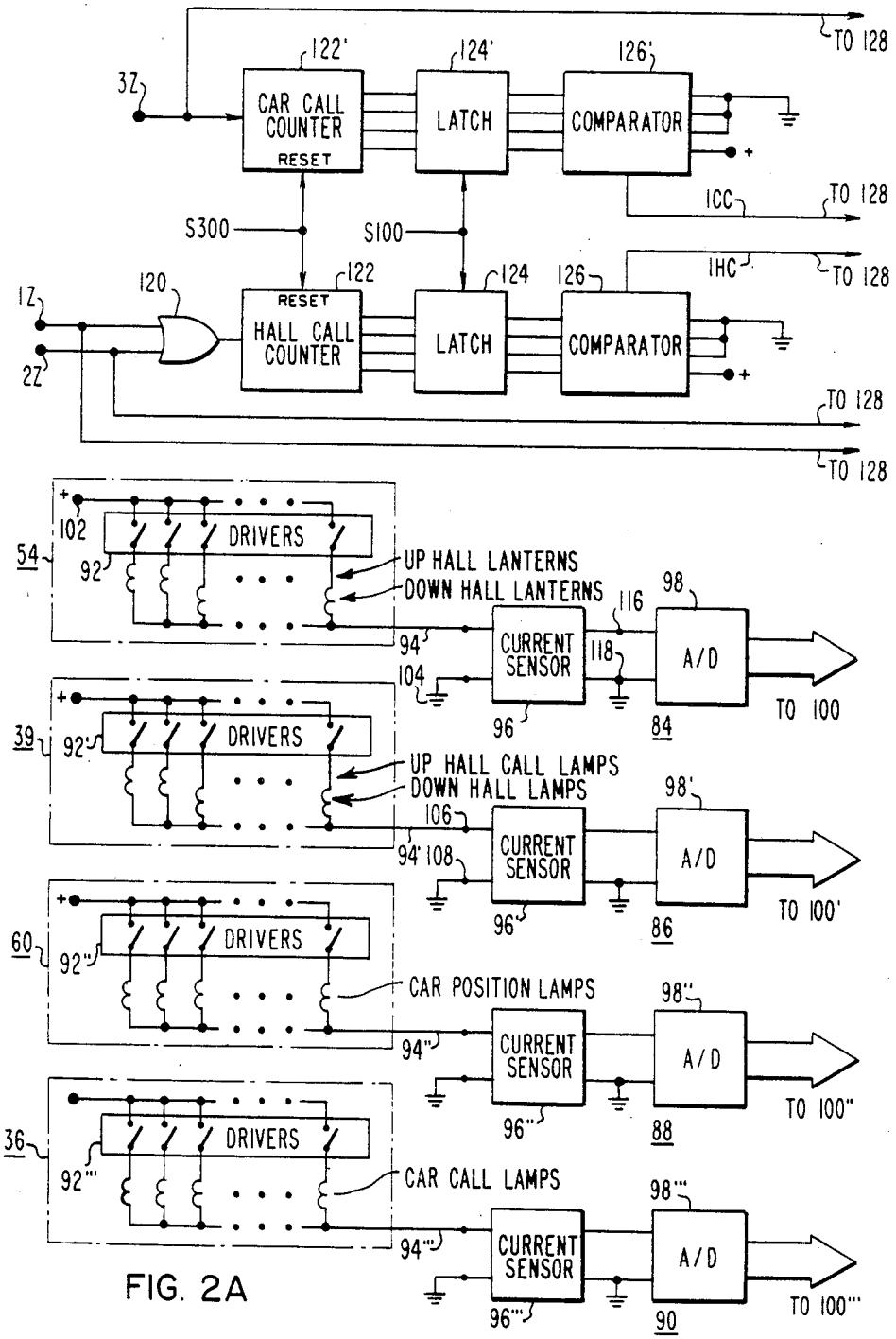
FIGS. 2A and 2B may be assembled to provide is a detailed schematic diagram of the burned-out lamp detector means shown in block form in FIG. 1.
Figure 2B:
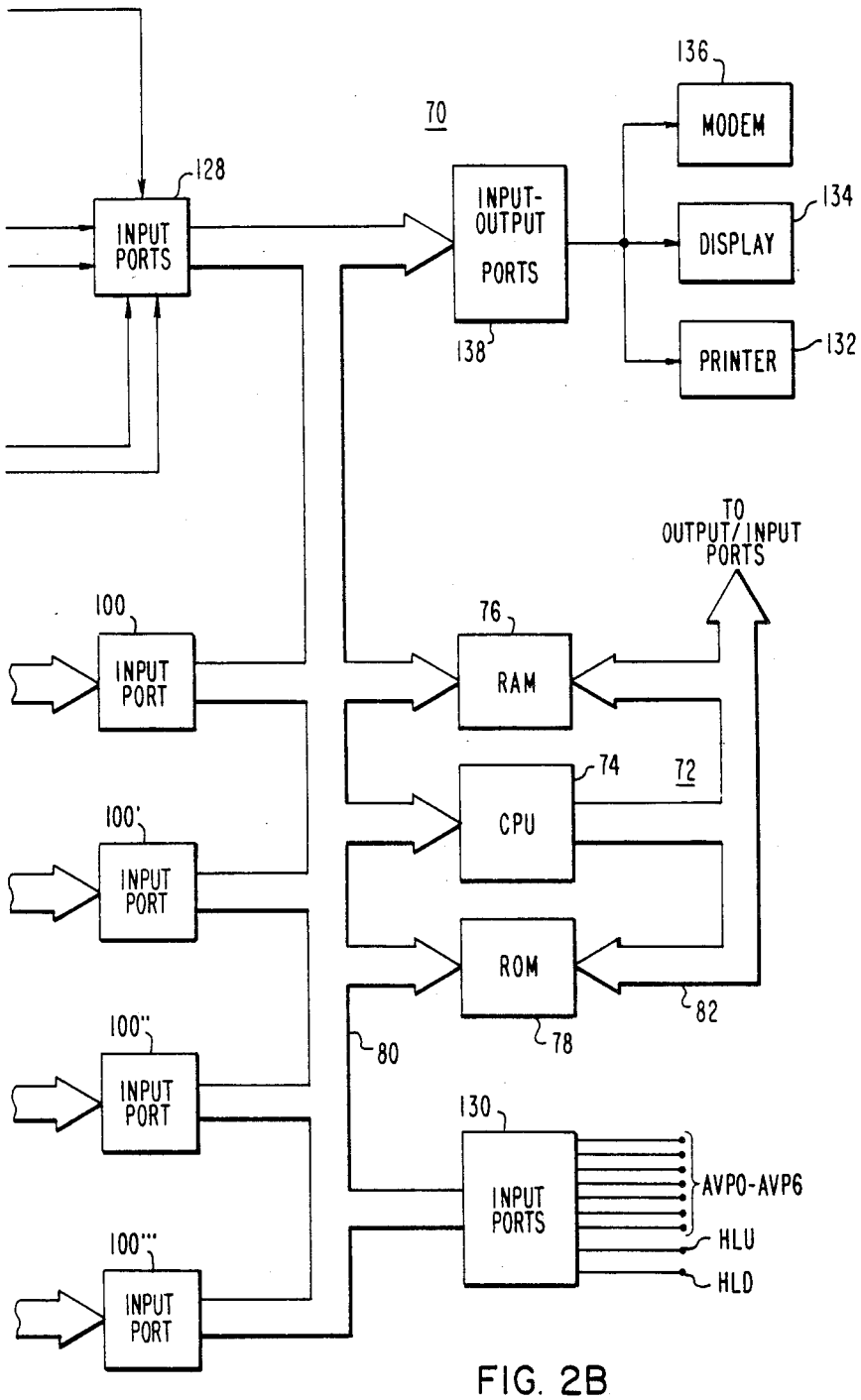

The car position indicator 60, the up and down hall lanterns 54, the up and down hall call pushbuttons 39, and the car call pushbuttons 36, all have lamps, or equivalent indicators, which may burn out. A burned-out lamp detector 70 is illustrated in block form in FIG. 1. Detector 70 automatically detects and stores in memory indications of burned-out lamps obtained from tests made from current flow detections and logic developed from elevator control signals, car calls, and hall calls. The tests are made while the elevator cars are operating normally. FIGS. 2A and 2B illustrate a block diagram of a burned-out lamp detector arrangement constructed according to the teachings of the invention, which may be used for that function shown in block form in FIG. 1.

More specifically, the burned-out lamp detector function 70 shown in FIGS. 2A and 2B includes a microcomputer 72 in FIG. 2B having a central processing unit (CPU) 74, a random accessory memory (RAM) 76, and a read-only memory (ROM) 78, linked by data bus 80 and address/control bus 82. Each function whose lamps or indicators are to be monitored and tested for burned-out elements includes current sensing means shown in FIG. 2A. For example, hall lantern function 54 includes current sensing means 84, hall call function 39 includes current sensing means 86, car position indicator function 60 includes current sensing means 88, and car call function 36 includes current sensing means 90.

The up and down hall call lamps of the hall call function each have first and second terminals. Their first terminals are connected to be selectively energized by drivers, shown generally at 92, and their second terminals are all connected to a common return conductor 94. The common return conductor 94 is connected to power supply ground 104 via a current sensor 96 which provides an analog signal responsive to the magnitude of the current flowing in conductor 94. The output of current sensor 96 is connected to an analog-to-digital converter 98 which provides a binary signal for input port 100. Thus, when a hall lantern is selected, its associated driver closes the circuit between power supply terminal 102 and the power supply ground 104.

Figure 3:
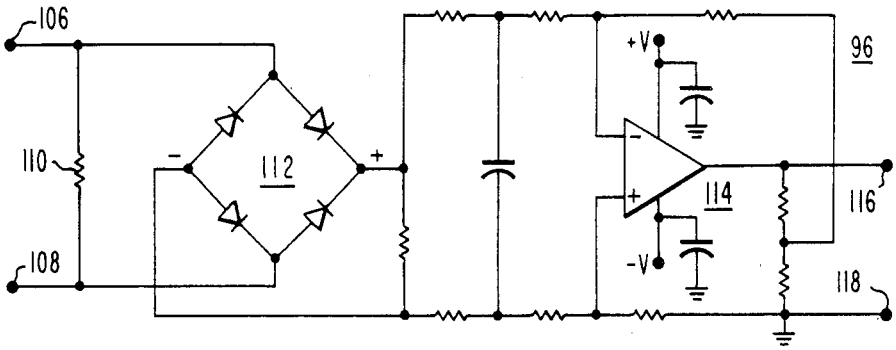
FIG. 3 is a schematic diagram of a current sensor which may be used for that function shown in block form in FIG. 2.

FIG. 3 is a schematic diagram of a circuit whch may be used for the current sensor function 96 shown in block form in FIG. 2A. The common return conductor 94 is broken at terminals 106 and 108, and a resistor 110 is inserted in series with conductor 94. The voltage drop across resistor 110 is thus a measure of the current flowing in the common return conductor 94. This voltage, if an alternating voltage, is rectified by a single phase, full-wave bridge rectifier 112, filtered, and applied to the inputs of an operation amplifier 114. The output terminals 116 and 118 provide a unidirectional analog measure of the current flowing in the common return conductor 94.

The remaining current sensing arrangements 86, 88, and 90 are all similar to current sensing arrangement 84, with like components having like reference numerals, except for prime marks.

The car and hall calls may be counted by software counters in the microcomputer 72, or by hardware counters, as desired. For example, the serial up and down hall calls 1Z and 2Z may be OR'ed by OR 120 and the output of OR 120 may be counted by a binary counter 122. Counter 122 is reset by timing signal S300 at the start of each serial string of hall call data, and the count is held in a latch 124 by timing signal S100 just before counter 122 is reset. A comparator 126 determines if the hall call count is equal to one. When the count is "one", the output signal 1HC of comparator 126 is driven high, i.e., to a logic one. In like manner, the serial string of car calls 3Z is counted by a counter 122', held by a latch 124' and compared with a "one" input in a comparator 126', which provides an output signal 1CC which is high when there is only one car call registered. Signals 1HC, 1CC, the car calls 3Z, and the up and down hall calls 1Z and 2Z, respectively, are made available to microcomputer 72 via input ports 128. The advanced car position signal AVPO-AVP6 and hall lantern signals HLU and HLD are made available to microcomputer 72 via input ports 130.

The information stored in RAM 76 relative to burned-out lamps may be printed out via a printer 132, it may be displayed on a display 134, and/or, it may be sent to a remote location via a modem 136, as desired, through appropriate input/output ports 138. A communication arrangement for communicating elevator service and maintenance information from an elevator system to a remote maintenance office is described in detail in U.S. Pat. No. 4,512,442 entitled "Method and Apparatus for Improving the Servicing of an Elevator System", which application is assigned to the same assignee as the present application.

Figure 5:
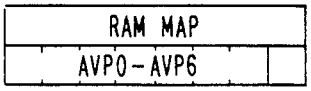
FIGS. 5, 6 and 7 are RAM maps illustrating burned-out lamp tables, call tables, and other variables stored during the operation of the program shown in FIG. 4.
Figure 7:
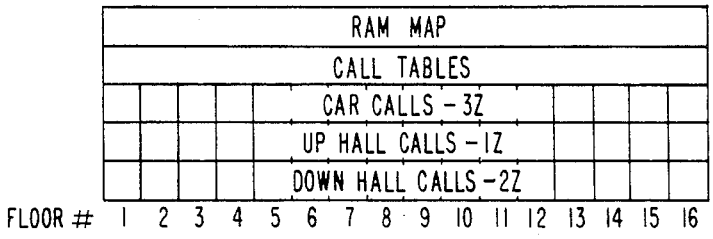
Figure 6:
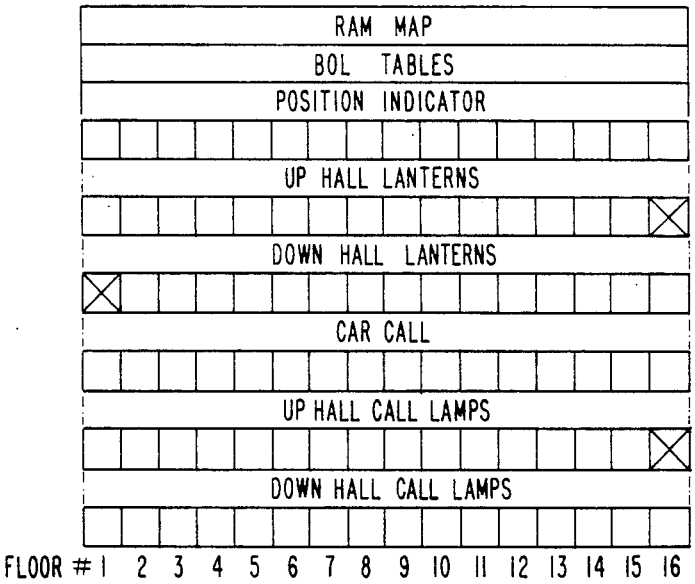
Figure 4:
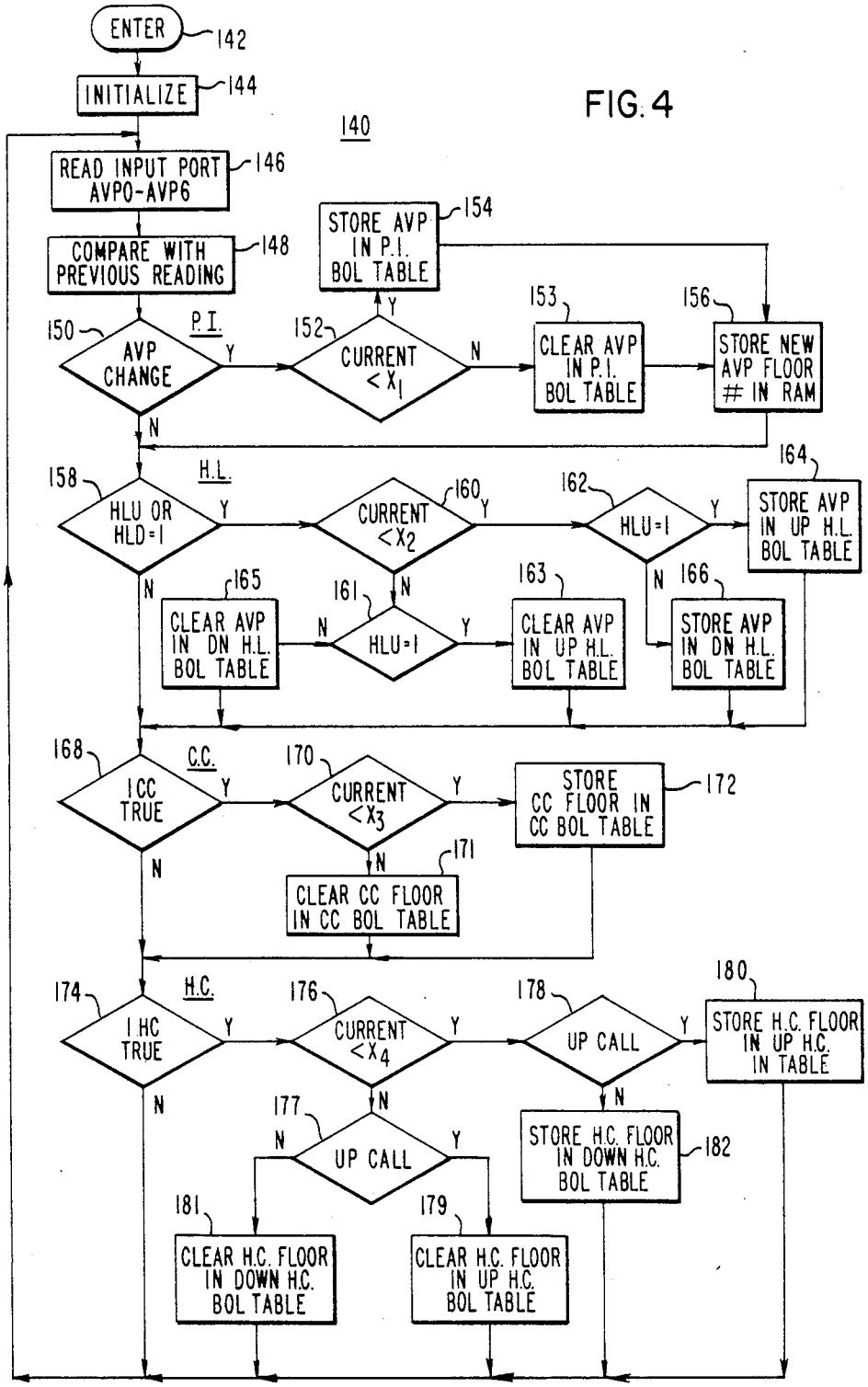
FIG. 4 is a flowchart of a program which may be used to provide logic for operating the burned-out lamp detector means shown in FIG. 2, according to the teachings of the invention.

FIG. 4 is a flowchart of a program 140 which may be stored in ROM 78, to provide the logic required to properly time the testing of the various lamps, as well as to determine which lamp is burned out when a test so indicates. FIGS. 5, 6, and 7 are RAM maps of storage locations in RAM 76, which will be referred to when appropriate while describing program 140.

Program 140 is entered at terminal 142 and step 144 initializes the various burned-out lamp (BOL) tables and other RAM storage locations for program variables (FIGS. 5, 6, and 7). Step 146 reads input port 130, which provides the advanced floor position AVP of the elevator car in the form of binary signal AVPO-AVP6. Step 148 compares this signal with the previous reading of AVPO-AVP6, which is stored in RAM, as illustrated in the RAM map of FIG. 5. Step 150 determines if the advanced car position has changed floors. If it has, a different lamp, or other suitable indicator, should now be energized in the car position indicator 60 located in the elevator car. Step 152 reads input port 100'', which provides the current magnitude, and it checks to see if the current magnitude is less than a value $X_1$. The value for $X_1$ is stored in ROM 78. It is selected such that if the actual current flow is less than this value, it indicates a burned-out lamp associated with this car position. This arrangement will detect burned-out elements in circuit arrangements which have a single element energized at a time, as well as circuits which have more than one lamp or indicator energized for each car position, simply by selecting the proper value for $X_1$. If the current magnitude is not less than $X_1$, step 153 clears the AVP floor number in the burned-out lamp (BOL) table for the car position indicator, shown in the RAM map of FIG. 6. For example, if there are 16 floors, and the AVP floor is floor #6, the program would clear the bit in the BOL table word which is in the column above the legend "Floor #6". If the current magnitude is less than $X_1$, step 152 goes to step 154 which sets the bit associated with the AVP floor number in the burned-out lamp (BOL) table for the car position indicator.

Step 154 proceeds to step 156, as does step 153 when the current magnitude is not less than $X_1$. Step 156 stores the new AVP floor number in the RAM location shown in FIG. 5.

Steps 150 and 156 both proceed to step 158 to initiate a check of the hall lanterns. This may be done by checking many different types of signals, depending upon the specific elevator system. In the elevator system of the incorporated patents, up and down hall lantern enable signals HLU and HLD are each driven high, or true, when an up or down hall lantern should be turned on. Thus, step 158 checks input port 130 shown in FIG. 2, to determine if either signal HLU or HLD is true. If step 158 finds signal HLU or signal HLD is a logic one, step 160 determines the magnitude of the current flowing in the hall lantern circuits by checking input port 100 shown in FIG. 2. Step 160 then compares this magnitude with a value $X_2$ stored in ROM. If some hall lanterns, such as those at the lobby floor, have two lamps per service direction the value of $X_2$ will be floor related, being selected to be a magnitude which will detect one burned-out lamp at a dual lamp floor, and having a magnitude which will detect a single burned-out lamp at locations having a single lamp. If the current magnitude is not less than $X_2$, step 161 determines which service direction has the burned-out element. For example, step 161 may check to see if the up direction hall lantern signal HLU is true. If so, step 163 clears the bit associated with the AVP floor number defined by input signal AVPO-AVP6 in the up hall lantern BOL table of FIG. 6. If signal HLU is not true, step 165 clears the bit associated with the AVP floor number in the down hall lantern BOL table of FIG. 6. If the current magnitude is less than $X_2$, indicating a burned-out element, step 162 checks service direction, with step 164 setting the bit in the up hall lantern BOL table associated with the AVP floor number for the up direction, and with step 166 performing a similar function in the down hall lantern BOL table for the down service direction.

The "no" branch of step 158, as well as steps 163, 164, 165 and 166, all proceed to step 168 which is the part of the program which tests the lamps associated with the car call pushbuttons 36. For example, step 168 may check input port 128 to see if signal 1CC is true. If it is, it indicates only one hall call is registered. Thus a lamp or indicator associated with only one car call button should be energized, and the car call lamp test may be made. The car call signal 3Z is also read into memory (FIG. 7) via input port 128. Thus, instead of using the hardware counter of FIG. 2, the registered car calls may be counted in step 168 to determine if only one car call is registered, if desired. If signal 1CC is true, step 170 determines the magnitude of the current flowing in the car call lamp circuit 36 by checking input port 100''', and it compares this value with $X_3$, which is a value stored in ROM. If the magnitude of the current is less than $X_3$, step 172 stores an indication of a burned-out element in the car call BOL table of FIG. 6. The floor number associated with the burned-out element may be determined by checking the car call table in FIG. 7, to determine which car call is registered. If the magnitude of the current is not less than $X_3$, step 171 clears this location of the car call BOL table.

If signal 1CC is not true, the program advances to step 174, as do steps 171 and 172. Step 174 initiates the testing of the hall call pushbutton lamps, which is made only when a single hall call is registered. For example, step 174 may check input port 128 to determine if signal 1HC is true. Alternatively, it may count the hall calls in the hall call tables of FIG. 7. If signal 1HC is true, step 176 reads input port 100' to determine the magnitude of the current flowing in the hall call lamp circuits. Step 176 compares this current magnitude with a value $X_4$ stored in ROM 78. If the current flow is less than $X_4$, step 178 determines if the defective lamp is associated with the up hall call pushbuttons or with the down hall call pushbuttons. For example, step 178 may check the call tables in FIG. 7 to determine if an up hall call is registered. If an up hall call is registered, step 180 stores the floor number associated with the registered hall call in the up hall call BOL table in FIG. 6. If step 178 finds an up hall call is not registered, then it must be a down hall call that is registered, and step 182 reads the down hall call tables in FIG. 7 to determine the floor number associated with the registered hall call. Step 182 stores the floor number in the down hall call BOL table. If the magnitude of the current flow is not less than $X_4$, step 177 checks the call direction, with step 179 clearing the associated bit in the up hall call BOL table for an up call, and with step 181 clearing the associated bit in the down hall call BOL table. Steps 179, 180, 181 and 182 return to step 146, to repeat the lamp tests hereinbefore described.

In summary, there has been disclosed a new and improved elevator system which develops logic during the normal running of the elevator system for checking every lamp, or equivalent indicator, to determine if there is a burned-out element. Further, the testing circuitry utilizing the logic, requires only one current magnitude sensor for each elevator function to be tested, regardless of the number of lamps or indicators associated with each elevator function.

We claim as our invention:

1. An elevator system, comprising:

a building having a plurality of floors, an elevator car mounted for movement in said building to serve the floors, at least one lamp associated with each floor, with each of said lamps having first and second terminals, first means for selectively energizing the first terminals of said lamps, with the second terminals of said lamps being connected to a common return, current detector means for detecting the magnitude of the current flowing in said common return, second means for determining when only the lamp, or lamps, associated with only one of said plurality of floors, should be energized, and burned-out lamp detector means responsive to said current detector means and said second means, storing an indication of a burned-out lamp, including the floor number associated with the lamp, when current flow in the common return is less than a predetermined value at a time when a lamp, or lamps, associated with only a single floor should be energized.

2. The elevator system of claim 1 wherein the lamps indicate the advanced floor position of the elevator car, the first means is responsive to the advanced car position for sequentially energizing said lamps, the second means is responsive to a change in the advanced car position, the predetermined value of the current flowing in the common return is selected to be less than the normal current of the advanced floor position lamps, and the burned-out lamp detector means stores the floor of the advanced car position when the current flow in the common return is less than said selected predetermined value.

3. The elevator system of claim 1 wherein the lamps function as up and down hall lanterns located at the floors of the building, and including means for providing hall lantern signals when an up or down hall lantern should be energized, with the first and second means being responsive to said hall lantern signals, the predetermined value of the current flowing in the common return is selected to be less than the normal current of the advanced floor position lamps, and with the burned-out lamp detector means storing the advanced floor position of the elevator car when current flow in the common return is less than said selected predetermined value.

4. The elevator system of claim 1 wherein the lamps function as car call registered indicators in the elevator car, and including car call pushbuttons in the elevator car associated with the floors and lamps, and means for determining when only one car call is registered, with the first means being responsive to actuation of a car call pushbutton, the second means being responsive to the means for determining when only one car call is registered, the predetermined value of the current flowing in the common return is selected to be less than the normal current of a car call registered lamp, and with the burned-out lamp detector means storing the floor number associated with the single car call when current flow in the common return is less than said selected predetermined value.

5. The elevator system of claim 1 wherein the lamps function as up and down hall call registered indicators located at the floors of the building, and including up and down hall call pushbuttons associated with the up and down hall call registered lamps, and means for determining when only a single hall call is registered, with the first means being responsive to the actuation of a hall call pushbutton, the second means being responsive to the means for determining when only one hall call is registered, the predetermined value of the current flowing in the common return is selected to be less than the normal current of a hall call registered lamp, and with the burned-out lamp detector storing the floor number associated with the single hall call, and the associated service direction, when current flow in the common return is less than said selected predetermined value.

6. An elevator system, comprising:

a building having a plurality of floors, an elevator car mounted for movement in said building to serve the floors, car position means for providing the advanced car position AVP of said elevator car in terms of a floor number, a car position indicator, including a lamp associated with each floor, with each of said lamps having first and second terminals, means responsive to the car positions means for selectively energizing the first terminals of said lamps, with the second terminals of said lamps being connected in common to a common return conductor, current detector means for detecting the magnitude of the current flowing in said common return conductor, car position change detector means for determining when the advanced car position changes to a different floor, and burned-out lamp detector means responsive to said current detector means, to said car position means, and to said car position change detector means, said burned-out lamp detector means including means for comparing the magnitude of the current provided by said current detector means with a predetermined value each time the car position change detector means indicates the advanced car position has changed to a different floor, and storing an indication of a burned-out lamp at the floor of the advanced car position provided by said car position means, when the magnitude of the current flowing in the common return is less than the predetermined value.

* * * * *